United States Patent [19]

Slotkowski

[11] 4,307,389

[45] Dec. 22, 1981

[54] DECODING CIRCUIT

[75] Inventor: Kenneth G. Slotkowski, Westland, Mich.

[73] Assignee: Ford Motor Company, Dearborn, Mich.

[21] Appl. No.: 143,960

[22] Filed: Apr. 25, 1980

[51] Int. Cl.[3] ..... G08B 19/00

[52] U.S. Cl. ..... 340/661; 340/52 F; 340/636; 340/662; 340/663; 340/664

[58] Field of Search ..... 340/660, 661, 662, 663, 340/664, 636, 328, 329, 331, 638, 52 F

[56] References Cited

U.S. PATENT DOCUMENTS

| | | | |
|---|---|---|---|
| 3,503,062 | 3/1970 | Witzke et al. | 340/636 |
| 3,550,105 | 12/1970 | DeCola et al. | 340/331 |
| 3,577,064 | 5/1971 | Nercissian | 340/664 X |
| 3,673,588 | 6/1972 | Riff | 340/636 X |
| 3,693,110 | 9/1972 | Briggs, Jr. et al. | 340/328 |
| 3,877,001 | 4/1975 | Bogut et al. | 340/636 |
| 3,927,399 | 12/1975 | Fuzzell | 340/636 X |
| 3,964,039 | 6/1976 | Craford et al. | 340/660 |
| 3,999,176 | 12/1976 | Kellogg et al. | 340/638 |
| 4,056,765 | 11/1977 | Scheidler et al. | 340/636 X |

OTHER PUBLICATIONS

Silicon General Data Sheet; Nov. 1978, Linear Integrated Circuits, SG1543/SG2543/SG3543.

RCA Solid State Division, Application Note ICA-N-6267, pp. 407–414, Nov. 1973, "Astable and Monostable Oscillators Using RCA CDS/MOS Digital Integrated Circuits" by Dean et al.

*Primary Examiner*—John W. Caldwell, Sr.

*Assistant Examiner*—Daniel Myer

*Attorney, Agent, or Firm*—Paul K. Godwin, Jr.; Clifford L. Sadler

[57] ABSTRACT

A circuit for sensing a plurality of inputs, each of which have a plurality of condition states, and providing a visibly coded output signal to a single indicator lamp, or the like, whereby one may readily determine the various condition states. The circuit is exemplified in an automotive voltage and current sensing system which senses the conditions of normal voltage, overvoltage, undervoltage and battery discharge. The circuit commands a single lamp to be off, to flash rapidly, to light continuously, or to flash slowly in correspondence to the particular sensed condition.

16 Claims, 1 Drawing Figure

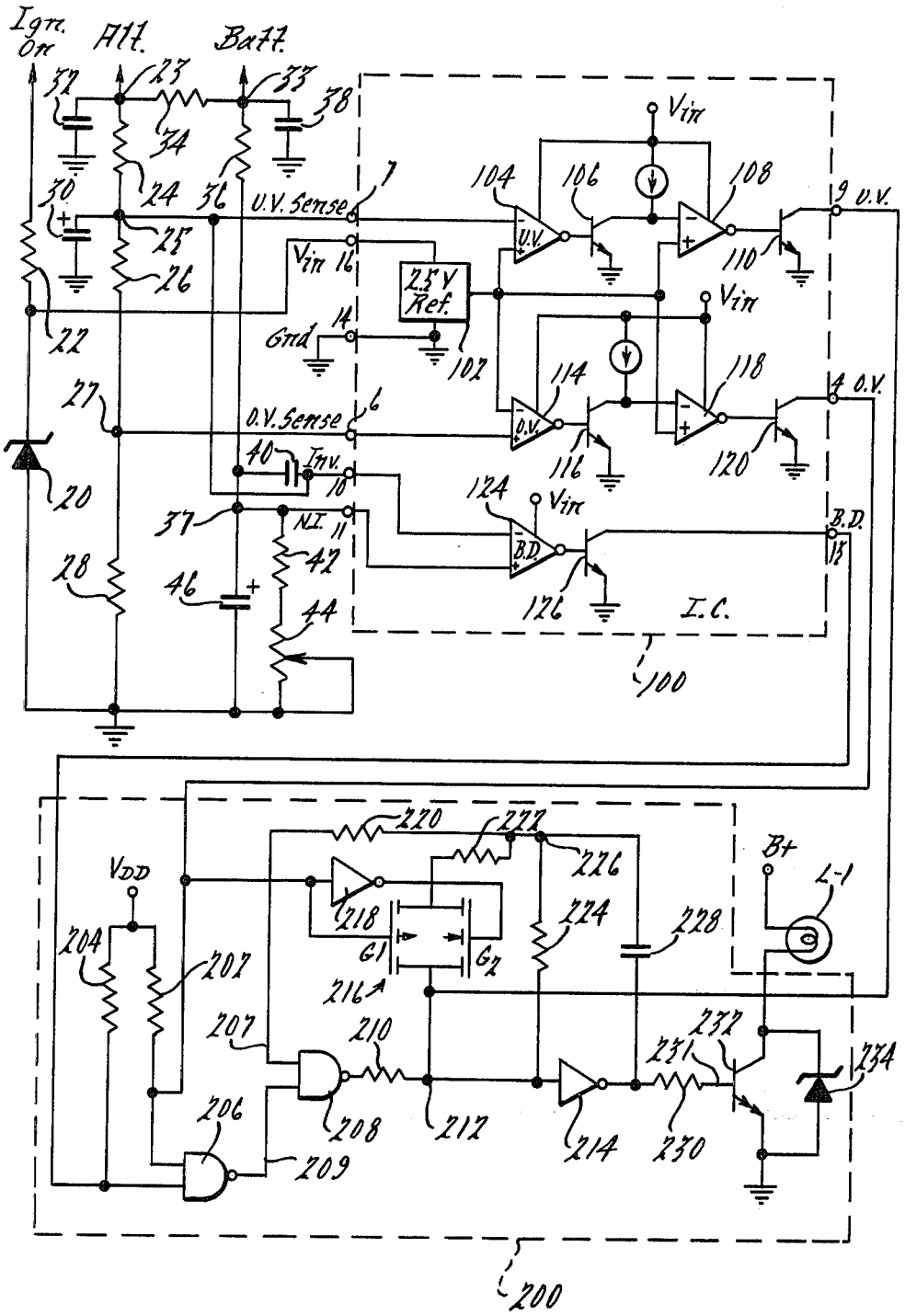
Ign. On
Alt.
Batt.
U.V. Sense
O.V. Sense
Vin
Gnd
2.5 V Ref.
U.V.
O.V.
B.D.
Inv.
N.I.
I.C.
VDD
B+
L-1
G1
G2

DECODING CIRCUIT

BACKGROUND OF THE INVENTION

1. Field of the Invention

The present invention is in the field of electronic circuitry employed for decoding information from a plurality of inputs and condensing that information to a readily discernible display format.

2. Description of the Prior Art

In the past it has been necessary to dedicate separate display lamps, or the like, with appropriate distinguishing legends or colors to convey status or condition information to a human operator in a low cost system. For instance in automotive applications status conditions of alternator output is generally indicated with a single lamp that is off when the alternator voltage is above a minimum value and continuously on when the alternator voltage is below that minimum value. If additional information concerning the discharge of a battery is desired, it is commonly monitored by a separate volt meter connected across a shunt resistor between the alternator and battery.

Integrated circuits have been developed which may be connected to sense undervoltage, overvoltage, current conditions and then produce separate outputs corresponding to the state of each sensed condition. These outputs are connected, respectively, to corresponding separate indicator lamps.

SUMMARY OF THE INVENTION

The present dictates of the automotive industry require a large number of display features to be included within vehicles that are decreased in size, without any increase in assembly complexities. The present invention not only meets the present requirements but provides for increased display features and at the same time provides a decrease in assembly complexities. The present invention provides more information than is traditionally available concerning vehicle electrical systems and provides a single indicator lamp, or the like, that is precisely controlled to communicate the variously sensed conditions. The present invention also reduces assembly complexities, when compared to the multiple indicators employed in the past.

The present invention includes an astable multivibrator having a switchable time constant feature and a constant on feature controllable by a plurality of inputs to provide a discernible output signal employed to drive a single indicator lamp.

It is, therefore, an object of the present invention to provide a low cost alternative to the multiple indicators and gauges conventionally employed to display detectable information.

It is another object of the present invention to provide a decoding circuit which receives a plurality of input conditions along separate signal lines and converts the several conditions to discernible conditions for modulating a single indicator in distinctly different patterns easily interpreted by a human operator.

It is a further object of the present invention to provide an improved electrical system condition warning system and display system which provides a plurality of status condition indications with a single indicator lamp.

BRIEF DESCRIPTION OF THE DRAWING

The FIGURE is an electrical schematic of the preferred embodiment of the present invention.

DETAILED DESCRIPTION OF THE PREFERRED EMBODIMENT

The embodiment of the invention shown in the FIGURE is intended for use on a automotive vehicle wherein the electrical system condition is monitored. Warnings for such abnormal condition states as overvoltage, undervoltage and battery discharge current are produced and displayed in a unique manner.

A conventional integrated circuit chip 100, such as that commercially designated as SG 1453, is employed to sense the above designated condition states and provide correspondingly respective outputs on separate output lines.

Power to activate the chip 100 is provided at the $V_{IN}$ terminal 16 from a junction between a dropping resistor 22 and a Zener diode 20. The dropping resistor 22 and Zener diode 20 are series connected between the vehicle ignition switch and ground.

The chip 100 contains a precision voltage reference circuit 102 that provides a 2.5 volt reference voltage to two comparators 104 and 114. An overvoltage sensing terminal 6 and undervoltage sensing terminal 7 of the chip 100 are connected across a dropping resistor 26 that is series connected in a voltage dividing circuit comprising resistors 24, 26 and 28 connected between the alternator output terminal and ground. An electrolytic capacitor 30 is connected between resistors 24 and 26 and functions to limit destructive transients and prevent false indication due to the transients. A capacitor 32 is connected at junction 25 between resistor 24 and the alternator to also limit transients and prevent false indication due to the transients.

Typically, in a 12 volt system the alternator produces a voltage of approximately 14.1 volts. Resistors 26 and 28 are selected to that the comparator 104 will activate transistor 106 and comparator 108 whenever the voltage from the alternator drops below 11.79 volts. The sensing of undervoltage causes the normally off-biased output transistor 110 to be biased on and thereby presenting a low impedance between the output terminal 9 and ground.

Similarly, the value selected for resistors 26 and 28 allows the activation of comparator 114, transistor 116 and comparator 118 whenever the alternator voltage increases above 15.88 volts. Whenever an overvoltage is sensed, the normally off-biased output transistor 120 is biased on to present a low impedence path between the output terminal 4 and ground.

Discharge current above a predetermined value is also sensed by the chip 100. A shunt resistor 34, such as a 36 inch length of No. 10 copper wire, is connected between the alternator terminal 23 and the battery terminal 33. Therefore, whenever the accessory load of the vehicle, which is connected to the alternator terminal 23, draws an excessive amount of current and drops the alternator voltage below that of the battery, the current through resistor 34 produces a voltage drop thereacross.

A battery discharge current comparator 124 in the chip 100 has an inverting input terminal 10, which is connected to the undervoltage sensing terminal 7. The comparator 124 also has a noninverted input terminal 11, which is connected to the junction 37 of a voltage divider network comprising resistor 36 and resistor 42 in series with a potentiometer 44. The voltage divider network is connected between the battery terminal 33 and ground. The potentiometer 44 is adjusted to provide a threshold of discharge current which will trigger the battery discharge comparator 124. An electrolytic capacitor 46 is connected between the noninverting input terminal 11 and ground to provide a low-pass filter for transients. A capacitor 38 is connected to the junction between the resistor 34 and the resistor 36 at the battery terminal to provide a low-pass filtering function. A capacitor 40 is connected between the inverting input terminal 10 and the noninverting input terminal 11 in order to eliminate differential noise to the comparator 124. When the discharge current across resistor 34 is excessive, the voltage difference between the terminals 10 and 11 is sufficient to activate the battery discharge comparator 124 which produces an output signal to bias the transistor 126 on and, therefore, provide a low impedance path between the output terminal 13 and ground.

The decoder circuit of the present invention is designated as 200. The decoder circuit 200 includes a NAND gate 206 having input terminals connected, respectively, to the overvoltage terminal 4 and the battery discharge terminal 13 on the chip 100. Each of the input terminals on NAND gate 206 are connected through respective resistors 202 and 204 to a voltage source $V_{DD}$. These resistors are termed "pullup" resistors in that they supply voltage to an otherwise electrically dead terminal.

The output of NAND gate 206 is connected to one of the input terminals of a NAND gate 208 through an input line 209. NAND gate 208 forms one component of an astable multivibrator which is activated by a high level "1" signal on the input line 209. The output of nand gate 208 is connected to one end of a resistor 210 and the opposite end of the resistor 210 is connected to a junction 212. The input of an inverter 214 is also connected to the junction 212. The output of the inverter 214 provides the output signal from the astable multivibrator as delivered through a resistor 230 on a single bias line 231 to gate a Darlington type transistor 232 for driving an indicator lamp L-1. The output of the inverter 214 is also connected to an feedback capacitor 228, which forms a charging network with resistor 224 connected back to the input of the inverter 214. The capacitor 228 and the resistor 224 are connected together at a junction 226. One end of a resistor 220 is also connected to the junction 226 and its opposite end is connected via line 207, to the second input of NAND gate 208.

A Zener diode 234 is shown connected between the collector and emitter of the driver transistor 232, in order to provide transient voltage protection to that transistor.

A secondary selectable charge discharge path for capacitor 228 is provided by resistor 222 having one end connected to the junction 226 and the other end connected to a bilateral switch 216. In discrete components the bilateral switch is formed by two complementary N and P channel MOS/FETs connected between the resistor 222 and junction 212. Gates $G_1$ and $G_2$ of the bilateral switch 216 are normally off-biased, providing an open circuit between the resistor 222 and the junction 212. However, when an overvoltage condition is sensed, the bilateral switch is gated on and a low impedance condition exists for bidirectional current flow in the secondary charged discharge path of resistor 222, connected between junction 226 and junction 212. When switched on, the resistor 222 is connected and parallel with resistor 224 and changes the RC time constant of the multivibrator to provide a higher oscillation frequency.

When the system is in operation and no abnormal state conditions are sensed, the output terminals 9, 4 and 13 each offer a high impedance to ground. In such a case, the input terminals for NAND gate 206 are each in a high level "1" state and the output of NAND gate 206 on line 209 is a low level "0" state. The second input to NAND gate 208 on line 207 is also a "1" due to the fact that capacitor 228 is charged. Therefore, the output of NAND gate 208 is a "1," and the inverter 214 provides a "0" level output. The "0" output of inverter 214 biases the transistor 232 in an off condition thereby preventing the lamp L-1 from being illuminated. This normal condition is shown in the first line of the truth table.

When the battery discharge current exceeds a predetermined amount, as set by potentiometer 44, the impedance level at the output terminal 13 of the chip 100 is reduced to "0" causing the total amount of voltage $V_{DD}$ to be dropped across resistor 204 and thereby presenting a "0" level to the corresponding input terminal of NAND gate 206. The output of NAND gate 206 would then change to present an output level of "1" on line 209 to the input of NAND gate 208. At that point, the input signals to NAND gate 208 are a "1" on line 209 and a "1" on line 207. Therefore, the output of NAND gate 208 is switched to a "0," which causes the output of inverter 214 to go to a "1" level. The "1" level on the output of inverter 214 causes the previously charged capacitor 228 to discharge through resistor 224 until a threshold level is reached at the input 207 of NAND gate 208. When that threshold level is reached, the NAND gate 208 output voltage is switched back to the "1" level. This "1" level is communicated to the input of the inverter 214 causing its output to switch to a "0" level and causing the capacitor 228 to charge. When the capacitor 228 charges sufficiently to cause the voltage on line 207 to reach the threshold of NAND gate 208, its output is switched to a "0" and the capacitor 228 will again discharge. The alternating output voltage levels from the inverter 214 are communicated across resistor 230 to correspondingly gate the driving transistor 232 on and off and thereby cause the lamp L-1 to also be illuminated and extinguished in a cyclical fashion at an approximate 1 Hz repetition rate, as determined by the RC time constant of the capacitor 228 and resistor 224. This battery discharge sensed condition is shown in the second line of the truth table.

In the event that an overvoltage condition is sensed by the chip 100, the transistor 120 is gated on to provide a low impedance path between the output terminal 4 and ground. In such a case, the voltage level at the corresponding input terminal of NAND gate 206 connected to terminal 4 will be in a "0" level condition, while the other input terminal of NAND gate 206 is in a "1" level condition. The "0" level of the input to the inverter 218 is also present on the gate $G_1$ of the bilateral switch 216. The output of the inverter 218 communicates a "1" level signal to the gate $G_2$ of the bilateral switch 216. With a "0" on $G_1$ and a "1" on $G_2$, the bilateral switch 216 provides a bidirectional low impedance path between one end of the resistor 222 and the junction 212, thereby connecting the resistor 222 in parallel with resistor 224. The output of NAND gate 206 switches to a high level "1" which is fed to the input of NAND gate 208 on the input line 209. Both input lines 207 and 209 are at a "1" value, thereby providing a "0" level output from NAND gate 208. The astable multivibrator then begins to function as it did when a battery discharge current was sensed, except that now the RC time constant of the multivibrator has been changed by the parallel connected resistor 222. Therefore, an increased repetition rate signal of approximately 3 Hz is output to rapidly flash the lamp L-1 whenever an overvoltage condition is sensed. This overvoltage sensed condition is shown in the third line of the truth table.

If an undervoltage condition is sensed by the chip 100, the transistor 110 is gated on and provides a low impedance between the output terminal 9 and ground. The output terminal 9 is connected to junction 212, thereby grounding junction 212 and causing the inverter 214 to have a continuous high level output. This output causes the output driver transistor 232 to be continuously on as long as the undervoltage condition is sensed, providing a correspondingly continuous conducting path for the lamp L-1. This undervoltage sensed condition is shown in the fourth line of the truth table.

TRUTH TABLE

| 9 U.V. | 4 O.V. | 13 B.D. | LAMP |
|---|---|---|---|
| 1 | 1 | 1 | Off-Normal |
| 1 | 1 | 0 | Slow-Flash |
| 1 | 0 | 1 | Rapid Flash |
| 0 | 1 | 1 | Continuous |

While the present invention is described in combination with an automotive electrical system condition sensing chip, it is believed that the practical use for this circuit is considerably broader since, in this case, a single lamp L-1 assumes four different states (off, slow flash, rapid flash, continuous on) to communicate a corresponding number of information pieces. Therefore, it will be apparent that many modifications and variations may be effected without departing from the scope of the novel concept of this invention. It is intended by the appended claims to cover all such modifications and variations which fall within the true spirit and scope of the invention.

I claim:

1. A circuit having a plurality of bi-level information input lines connected to receive bi-level information from an information source, and a single bi-level information output line translating the input information into an information distinguishable signal on said output line comprising:

means for sensing when the information on all input information lines is identical and responsively producing a constant low level output signal;

means for sensing when the information on a first one of said input lines is different from the other of said input lines and responsively producing an alternately high and low level output signal at a first frequency;

means for sensing when the information on a second one of said input lines is different from the other of said input lines and responsively producing an alternating high and low level output signal at a second frequency different from said first frequency; and means connected to said output line for producing discernible light radiation in response to said high level output signals and for not producing discernible light radiation in response to said low level output signals.

2. A circuit having a plurality of bi-level information input lines connected to receive bi-level information from an information source, and a single bi-level information output line translating the input information into and information distinguishable signal on said output line comprising:

means for sensing when the information on all input information lines is identical and responsively producing a constant low level output signal;

means for sensing when the information on a first one of said input lines is different from the other of said input lines and responsively producing an alternately high and low level output signal at a first frequency;

means for sensing when the information on a second one of said output signals is different from the other of said input lines and responsively producing a constant high level output signal; and means connected to said output line for producing discernible light radiation in response to said high level output signals and for not producing discernible output radiation in response to said low level output signals.

3. A circuit having a plurality of bi-level information input lines connected to receive bi-level information from an information source, and a single bi-level information output line translating the input information into an information distinguishable signal on said output line comprising:

means for sensing when the information on all input information lines is identical and responsively producing a constant low level output signal;

means for sensing when the information on a first one of said input lines is different from the other of said input lines and responsively producing an alternately high and low level output signal at a first frequency;

means for sensing when the information on a second one of said output signals is different from the other of said input lines and responsively producing a constant high level output signal;

means for sensing when the information on a third one of said input lines is different from the other of said input lines and responsively producing an alternately high and low level output signal at a second frequency different from said first frequency; and means connected to said output line for producing discernible light radiation in response to said high level output signals and for not producing discernible output radiation in response to said low level output signals.

4. A circuit as in claim 3 wherein said sensing means are defined by an astable multivibrator circuit having a first RC time constant network selectable to produce said first frequency alternating output signal in response to said information on said first input line being at a second level of said bi-level of information; and a second RC time constant network selectable to produce said second frequency alternating output signal in response to said information on said second input line being at a second level of said bi-level of information.

5. A circuit as in claim 4 wherein said first RC time constant network includes a first resistor in series with a charging capacitor and said second RC time constant network includes a second resistor connected in series with a bilateral switch, wherein said second resistor and bilateral switch are connected in parallel across a first resistor.

6. A circuit as in claim 5 wherein said bilateral switch is connected to be gated on by said second input line information being at a second level and gated off by said second input line being at a first level.

7. A power supply monitoring circuit connected to the voltage output of said power supply to sense and indicate variations in said voltage from predetermined permissible limits comprising:

means connected to said voltage output for dividing said voltage into a plurality of distinct levels that represent said permissible limits;

condition sensing means connected to said dividing means for producing first and second output signals of a first level when said voltage output is sensed to be in a first condition within said permissible limits, a first output signal of a second level and a second output signal of a first level when said voltage output is sensed to be in a second condition greater than said permissible limits and a first output signal of a first level and a second output signal of a second level when said voltage output is sensed to be in a third condition less than said permissible limits;

means connected to receive said first and second output signals for converting said first and second output signals to a single driving signal having a plurality of distinct level and duration characteristics respectively corresponding to said sensed output voltage condition being either within, greater than, or less than said permissible limits; and a single light radiation means connected to receive said driving signal and to responsively produce a visual indication of said sensed output voltage condition.

8. A power supply monitoring circuit as in claim 7, wherein said condition sensing means further includes means connected to said divider means for sensing the current flow condition of said power supply and producing a third output signal of a first level when said current flow condition is within a permissible predetermined limit and a second level when said current flow condition exceeds said predetermined limit;

said converting means is connected to also receive said third output signal and for converting said third output signal to said driving signal having a corresponding level and duration characteristic distinct from those of said sensed output voltage condition; and said single light radiation means connectd to also responsively produce a visual indication of said current flow condition.

9. A power supply monitoring circuit as in claim 8, wherein said converting means produces a low level continuously driving signal keeping said single light radiation means off when said first, second and third output signals are all at a first level, indicating that the sensed voltage and current flow conditions are within permissible predetermined limits.

10. A power supply monitoring circuit as in claim 9, wherein said converting means produces a repetitive high level driving signal at a first repetition frequency for responsively flashing said single light radiation means on and off when said first and second output signals are both at a first level and said third output signal is at a second level indicating that only said sensed current flow conditions exceeds said permissible predetermined limits.

11. A power supply monitoring circuit as in claim 10, wherein said converting means produces a repetitive high level driving signal at a second repetition frequency, higher than said first repetition frequency, for responsively flashing said single light radiation means on and off when said second and third output signals are both at a first level and said first output signal is at a second level indicating that said sensed voltage output is greater than said permissible predetermined limits.

12. A power supply monitoring circuit as in claim 11, wherein said converting means produces a high level continuous driving signal for responsively and continuously activating said single light radiation means when said first and third output signals are both at a first level and said second output signal is at a second level indicating that said sensed voltage output is less than said permissible predetermined limits.

13. A power supply monitoring circuit as in claim 7, wherein said converting means includes an astable multivibrator with a plurality of selectable frequency rates.

14. A power supply monitoring circuit as in claim 7, wherein said converting means produces a low level continuous driving signal keeping said single light radiation means off when said first and second output signals are both at a first level, indicating that the sensed voltage condition is within permissible predetermined limits.

15. A power supply monitoring circuit as in claim 14, wherein said converting means produces a repetitive high level driving signal at a predetermined repetition frequency for responsively flashing said single light radiation means on and off when said second output signal is at a first level and said first output signal is at a second level, indicating that said sensed voltage output is less greater than said permissible predetermined limits.

16. A power supply monitoring circuit as in claim 15, wherein said converting means produces a high level continuous driving signal for responsively and continuously activating said single light radiation means when said first output signal is at a first level and said second output signal is at a second level indicating that said sensed voltage output is less than said permissible predetermined limits.

* * * * *